US009624016B1

(12) United States Patent
Lidey

(10) Patent No.: US 9,624,016 B1
(45) Date of Patent: Apr. 18, 2017

(54) MULTI-SURFACE CABLE TYING DEVICE

(71) Applicant: Sean M Lidey, Anchorage, AK (US)

(72) Inventor: Sean M Lidey, Anchorage, AK (US)

( * ) Notice: Subject to any disclaimer, the term of this patent is extended or adjusted under 35 U.S.C. 154(b) by 0 days.

(21) Appl. No.: 15/277,416

(22) Filed: Sep. 27, 2016

(51) Int. Cl.
*B65D 63/00* (2006.01)
*B65D 63/10* (2006.01)

(52) U.S. Cl.
CPC ..... *B65D 63/1027* (2013.01); *B65D 2563/10* (2013.01); *B65D 2563/103* (2013.01)

(58) Field of Classification Search
CPC .. B65D 63/1027; B65D 63/10; B65D 63/103; B65D 63/1081; F16L 3/2336; F16L 3/2332; Y10T 24/1498; Y10T 24/141
See application file for complete search history.

(56) References Cited

U.S. PATENT DOCUMENTS 3,246,439 A * 4/1966 Foster, Jr. ..... E04B 9/20 248/205.3
3,924,299 A 12/1975 McCormick
4,045,843 A * 9/1977 Loose ..... B65D 63/1018 24/16 PB
4,263,697 A * 4/1981 Speedie ..... B65D 63/1081 24/16 PB
5,146,654 A * 9/1992 Caveney ..... B29C 45/0053 24/16 PB
5,470,520 A * 11/1995 Sorensen ..... B29C 45/4407 264/297.2
5,664,294 A * 9/1997 Sorensen ..... B65D 63/1072 24/16 PB
5,687,455 A * 11/1997 Alexander ..... B65D 63/1072 24/16 PB
5,884,367 A * 3/1999 Teagno ..... F16L 3/2332 24/16 PB
5,911,368 A * 6/1999 Davignon ..... B65D 63/1081 24/16 PB
6,185,792 B1 * 2/2001 Nelson ..... B65D 63/1072 24/16 PB
6,382,570 B1 5/2002 Simpson et al.
7,254,872 B2 * 8/2007 Ross ..... A44B 11/001 24/163 K
7,520,030 B2 * 4/2009 Laporte ..... B65D 63/1063 24/16 PB
8,069,537 B2 * 12/2011 Gallant ..... B65D 63/1018 24/16 PB (Continued)

*Primary Examiner* — Victor Batson
*Assistant Examiner* — Matthew Sullian
(74) *Attorney, Agent, or Firm* — Dale J Ream

(57) ABSTRACT

A multi-surface cable tie device includes a head member having an outer end and an opposed inner end, the head member defining an aperture having rectangular configuration and a channel defining a generally V-shaped configuration in communication with the aperture. The cable tie device includes an elongate tying strap that includes a base strip having a planar configuration that includes a proximal end adjacent the inner end of the head member and a distal end opposite the proximal end, the base strip having an elongate toothed portion mounted to an inside surface of the base strip. The toothed portion includes a generally triangular cross-section and having a plurality of teeth extending away from the base strip. The aperture is configured to selectively receive the base strip and the channel is configured to receive the toothed portion of the tying strap.

20 Claims, 15 Drawing Sheets

(56) References Cited

U.S. PATENT DOCUMENTS

| | | | | |
|---|---|---|---|---|
| 8,281,461 | B2 * | 10/2012 | Geiger | B65D 63/14 24/16 PB |
| 8,375,523 | B2 * | 2/2013 | Pilon | B65D 63/1081 24/16 PB |
| 8,920,095 | B2 * | 12/2014 | Baugh, Sr. | F16B 19/00 411/512 |
| 9,021,665 | B2 * | 5/2015 | Chen | B65D 63/1081 24/16 PB |
| 9,038,246 | B2 * | 5/2015 | Liang | B65D 63/1072 24/16 PB |
| 9,151,411 | B2 * | 10/2015 | Owen | B65D 63/1027 |
| 9,237,775 | B2 * | 1/2016 | Barfoot | A41F 1/008 |
| 2006/0096066 | A1 * | 5/2006 | Wambaugh | B65D 63/1063 24/16 PB |
| 2007/0234524 | A1 | 10/2007 | Witt | |
| 2010/0306967 | A1 | 12/2010 | Geiger | |
| 2011/0072623 | A1 | 3/2011 | Vermeer et al. | |
| 2012/0174355 | A1 * | 7/2012 | Fraze | A41F 1/008 24/68 A |
| 2012/0272486 | A1 | 11/2012 | Murphy et al. | |

* cited by examiner

MULTI-SURFACE CABLE TYING DEVICE

BACKGROUND OF THE INVENTION

This invention relates generally to cable tie device and, more particularly, to a cable tying device having multiple ratcheting teeth surfaces arranged in a generally triangular configuration to enhance the locking strength and minimize failure of the cable tying device.

Cable ties have been used for a long time for bundling and securing wires, cables, hoses, and other articles together so as to inhibit the lateral or rotational movement of the items. Cable ties generally provide a ratcheting system in which a flexible strap having teeth is inserted through a head or button member in a one-way only procedure. Like a winch, the cable tie fastener may be tightened by pulling the strap tighter. The typical cable tie includes a single row of teeth in a square or rectangular arrangement such that, even when tightened, are subject to failure if enough force or vibration is applied.

Although presumably effective for most applications, several recent airplane crashes have been attributed to fuel injector lines and other hoses or wires becoming detached from critical engine components. Preventing these accidents requires a more fail-safe cable tying device having more than one surface of teeth and a geometrical configuration that will withstand substantial pulling or vibratory forces.

Therefore, it would be desirable to have a cable tying device having multiple and angled surfaces with ratchet teeth that enhances the grip strength when engaged. Further, it would be desirable to have a cable tying device in which a tying strap includes a toothed portion having a triangular configuration and in which a head member defines a triangular channel having ratchet teeth capable of receiving the toothed portion in a more secure ratchet engagement.

SUMMARY OF THE INVENTION

A cable tie device according to the present invention includes a head member having an outer end and an opposed inner end, the head member defining an aperture having rectangular configuration and a channel defining a generally V-shaped configuration in communication with the aperture. The cable tie device includes an elongate tying strap that includes a base strip having a planar configuration that includes a proximal end adjacent the inner end of the head member and a distal end opposite the proximal end, the base strip having an elongate toothed portion mounted to an inside surface of the base strip. The toothed portion includes a generally triangular cross-section and having a plurality of teeth extending away from the base strip. The aperture is configured to selectively receive the base strip and the channel is configured to receive the toothed portion of the tying strap.

Therefore, a general object of this invention is to provide a multi-surface cable tie device for more securely bundling cables, wires, hoses, or other work pieces together even when subjected to abnormal or excessive forces or vibrations.

Another object of this invention is to provide a multi-surface cable tie device, as aforesaid, which includes a triangular toothed portion having a pair of inwardly angled walls and a corresponding head member having angled surfaces with ratchet teeth configured to receive the teeth of the toothed portion in a ratchet engagement.

Still another object of this invention is to provide a multi-surface cable tie device, as aforesaid, which is easy to use and cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
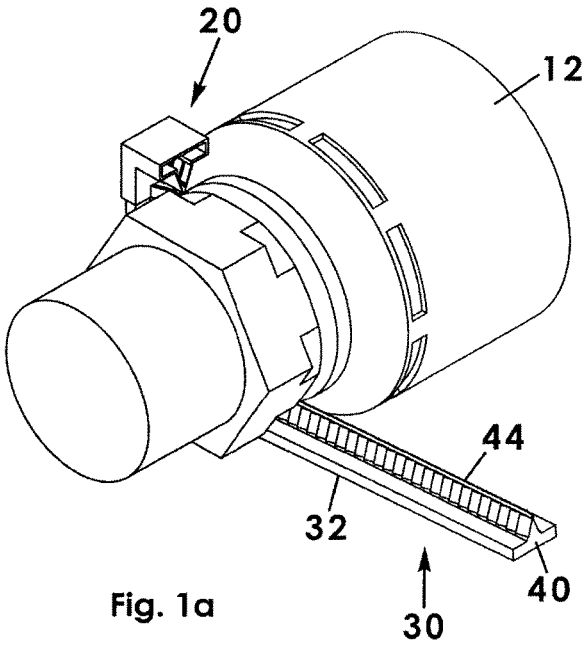
FIG. 1*a* is a perspective view of a multi-surface cable tie device according to a preferred embodiment of the present invention illustrated in an unengaged configuration.
Figure 1B:
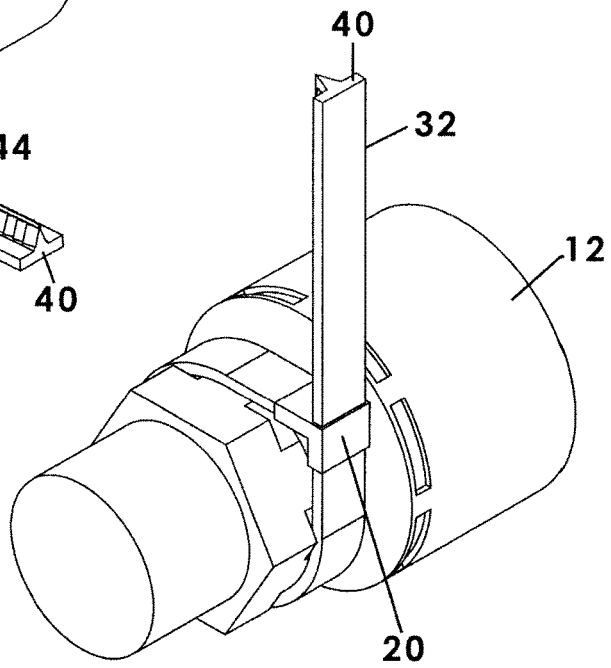
FIG. 1*b* is a perspective view of the cable tie device as in FIG. 1*a* illustrated in an engaged configuration.

A cable tying device according to a preferred embodiment of the present invention will now be described with reference to FIGS. 1*a* to 13*c* of the accompanying drawings. The cable tying device 10 includes a head member 20 and a tying strap 30 configured to secure a work piece 12 to another or even components of the same work piece.

With reference to FIGS. 1*a*, 1*b*, and 3 to 7*b*, the head member 20 of the cable tying device 10 includes an outer end 22 and an opposed inner end 24 and defines an aperture 26 adjacent the outer end 22 having a generally rectangular configuration. The aperture 26 may extend completely between top 25 and bottom 27 walls of the head member 20. The head member 20 further defines a channel 28 having a generally V-shaped configuration in operative communication with the rectangular aperture 26. The channel 28 may be referred to as having a triangular configuration or as being a notch. The head member 20 may have an L-shaped configuration defining an inlet 21 at a lower end and an outlet 23 at an upper end—both, however, being adjacent the outer end 22 of the head member 20. It is understood that the inlet and outlet are descriptive of where the tying strap 30 enters and exits the aperture 26 and channel 28, as will be further described below.

The tying strap 30 includes a base strip 32 having a generally flat or planar configuration and having a smooth outside surface 36. A proximal end 38 of the base strip 32 is coupled to the inner end 24 of the head member and a distal end 40 of the base strip 32 is displaced from and opposite the proximal end 38. In one embodiment, the distal end 40 may have a truncated configuration although a pointed tip configuration would also work. The tying strap 30 includes parallel side edges 42 extending between the proximal end 38 and distal end 40 so as to define a width of the base strip 32. The tying strap 30 may be constructed of a flexible plastic material so that it may be formed into a loop for insertion into and through the head member 20 as described below.

The tying strap 30 also includes a toothed portion 44 extending longitudinally between the proximal end 38 and distal end 40 of an inside surface 34 of the base strip 32, the toothed portion 44 preferably being positioned about midway between the side edges 42 and having a narrow width profile. The base strip 32 is wider than the toothed portion 44 such that the base strip 32 extends laterally on both sides of the toothed portion 44. In a preferred embodiment, the toothed portion 44 has a generally V-shaped or triangular configuration having a plurality of teeth 50 extending away from the base strip 32.

It is understood that the base strip 32 and aperture 26 have generally rectangular configurations and substantially similar dimensions. In like manner, the toothed portion 44 of the tying strap 30 and the channel 28 have generally V-shaped or triangular configurations and substantially similar dimensions. In other words, the head member openings and the tying strap 30 are "complementary" structures such that the head member 20 may selectively receive the tying strap 30 therethrough when inserted distal end 40 first.

Now, more particularly, the toothed portion 44 includes a first side wall 46 that is inclined or angled inwardly relative to the base strip 32 and a second side wall 48 that is angled inwardly toward the first side wall 46. Together, the side walls are joined at an apex 49 displaced from the base strip 32. Stated another way, each side wall includes a lower end adjacent the inside surface of the base strip 32 and spaced apart from one another. The apex 49 is opposite respective lower ends. The toothed portion 44 includes a generally triangular shaped cross-section.

Similarly, the V-shaped channel 28 includes a first surface having an inclined or angled surface that includes a plurality of ratchet teeth 29 spaced apart along respective surfaces. The channel 28 also includes a second surface having an inclined or angled surface that includes a plurality of ratchet teeth 29 (intentionally numbered the same as the aforementioned ratchet teeth). It is understood that the channel 28 is configured to receive or mate with respective ratchet teeth 29 when the tying strap 30 is inserted distal end first through the aperture 26 of the head member 20.

The plurality of ratchet teeth 29 and corresponding teeth 50 of the toothed portion 44 of the tying strap 30 are configured to selectively mate in a ratchet engagement. Specifically, the teeth 50 and the ratchet teeth 29 are positioned in opposite directions and configured as a pawl such that the plurality of teeth 50 of the toothed portion 44 are receivable only in a forward direction relative to the plurality of ratchet teeth 29. In the character of a winch, the tie strap 30 is not removable from the aperture 26 of the head member 20 except by severing or otherwise breaking engaged teeth.

In use, the cable tie device 10 is useful to holding items together. Specifically, the flexible tying strap 30 may be looped around cables, hoses, or wires and then secured together by engaging the tying strap 30 to the head member 20. Specifically, once looped around the objects to be secured, the distal end 40 of the base strip 32 is inserted into the aperture 26 of the head member 20 and respective teeth 50 of the toothed portion 44 are received by respective ratchet teeth 29 in the channel 28 in a one-way ratchet engagement.

Accordingly, the generally triangular configurations of the toothed portion 44 of the tying strap 30 and corresponding triangular channel 28 result in a much enhanced and secure fastening mechanism than any fastener previously proposed or implemented.

Another embodiment of the tying device 10' is shown in FIGS. 2 and 8 to 13*c* of the accompanying drawings and includes a construction substantially similar to that first described above except as specifically described differently below. Primed numerals are used to refer to the same components as previously designated—even if not specifically repeated below. Specifically, the head member 20' has a configuration that enables the tying strap 30 to be inserted and pulled through at a slightly different angle and to rest more securely upon curved objects being secured.

Figure 2:
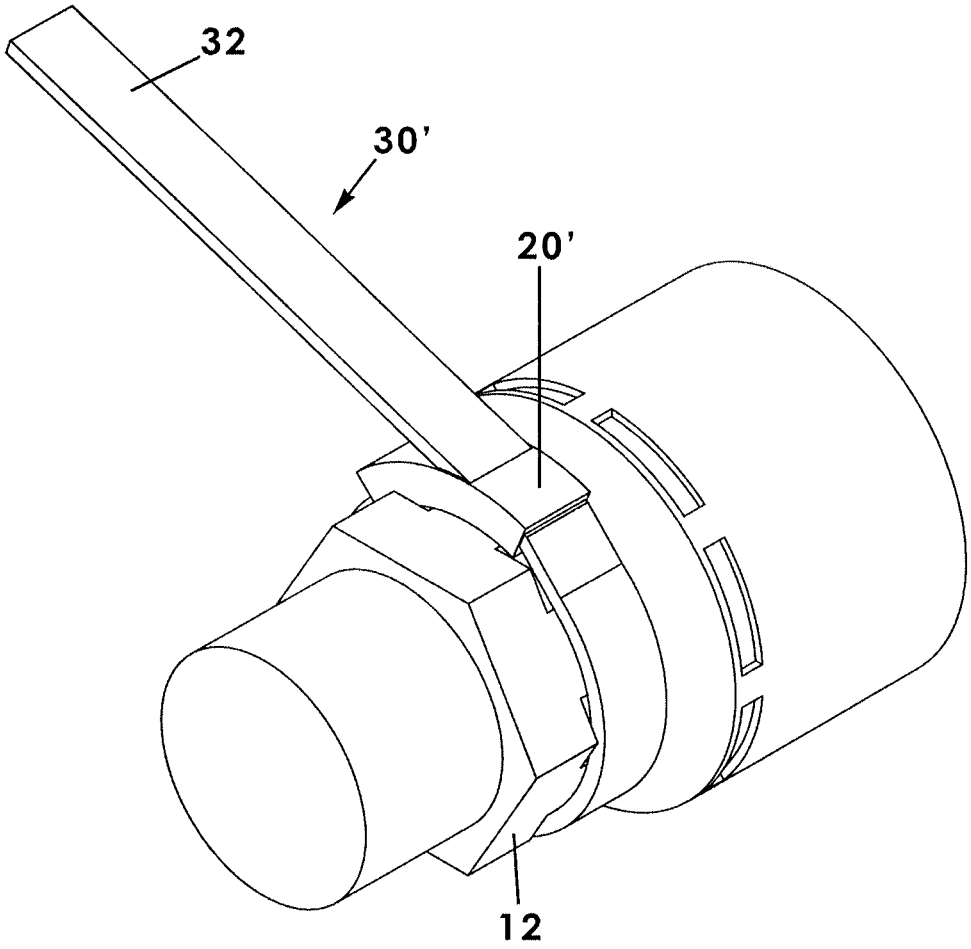
FIG. 2 is a perspective view of a cable tie device according to another embodiment of the present invention illustrated in the engaged configuration.
Figure 3:
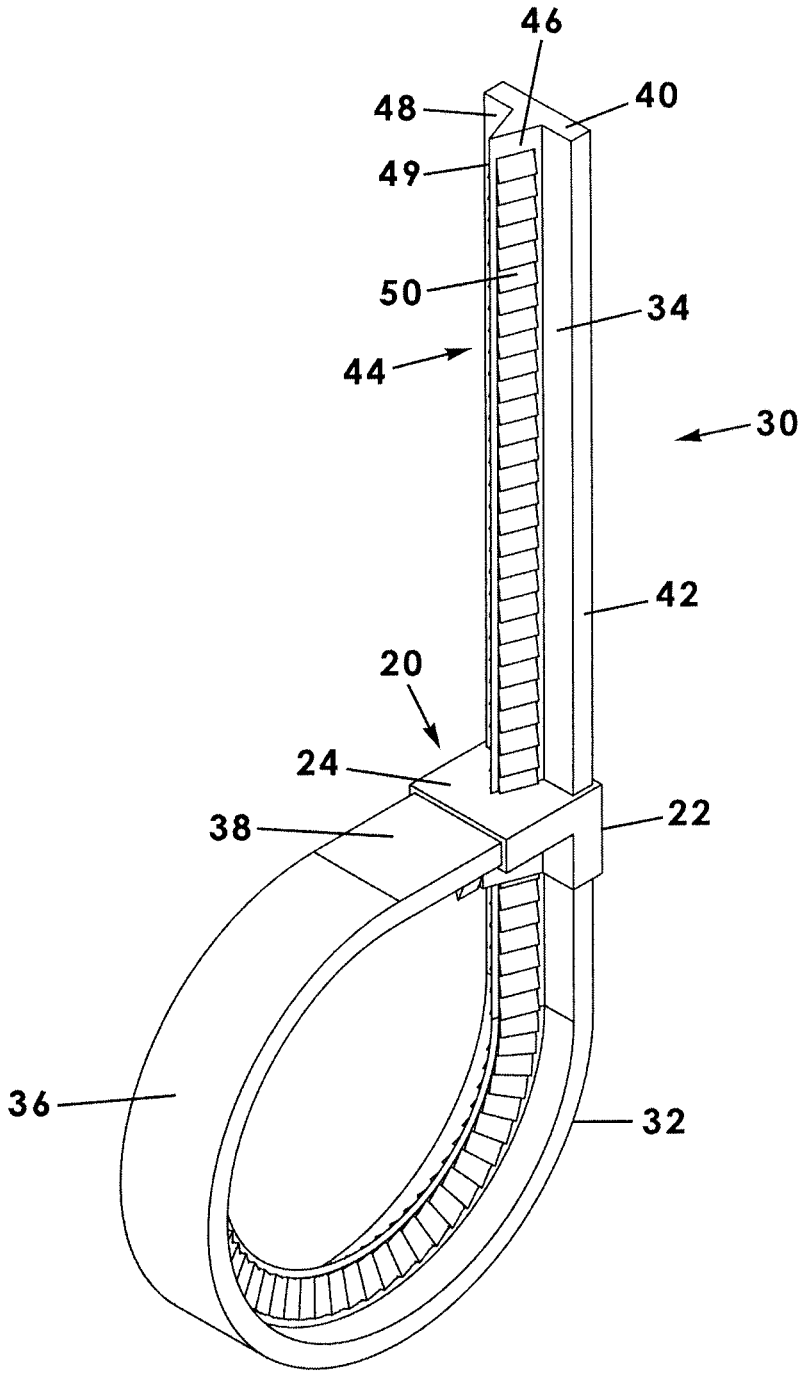
FIG. 3 is a perspective view of the cable tie device as in FIG. 1*b* removed from a work piece.
Figure 4A:
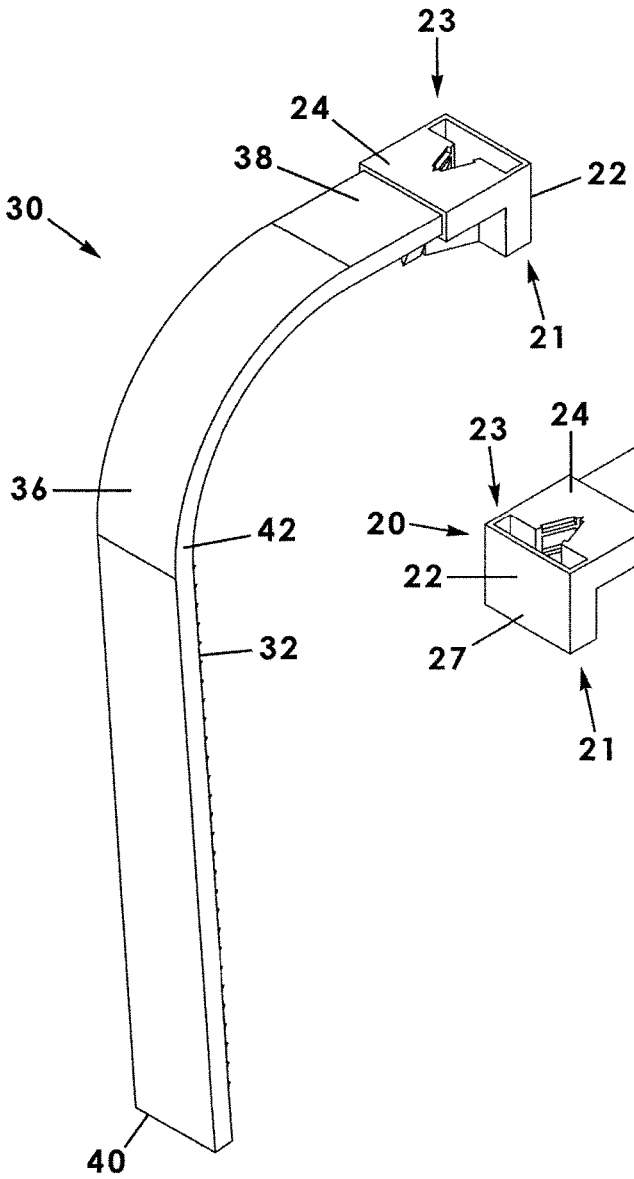
FIG. 4*a* is a rear perspective view of the cable tie device as in FIG. 1*a* removed from the work piece.
Figure 4B:
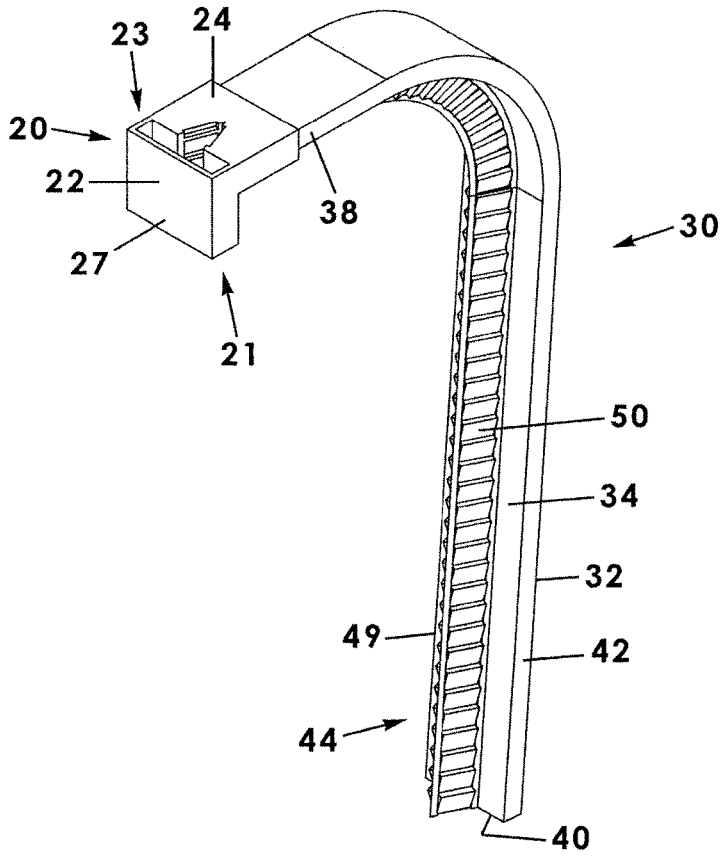
FIG. 4*b* is a front perspective view of the cable tie device as in FIG. 4*a;*
Figure 5:
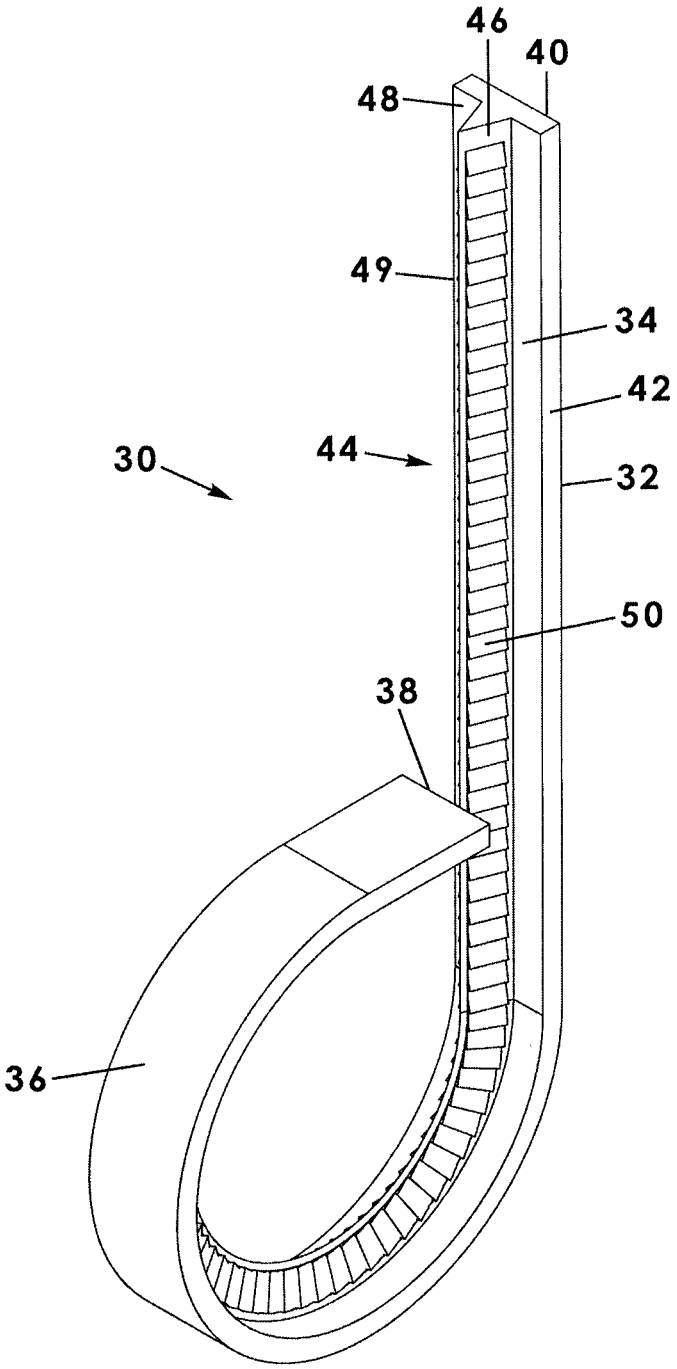
FIG. 5 is an isolated perspective view of a tying strap according to the present invention.
Figure 6:
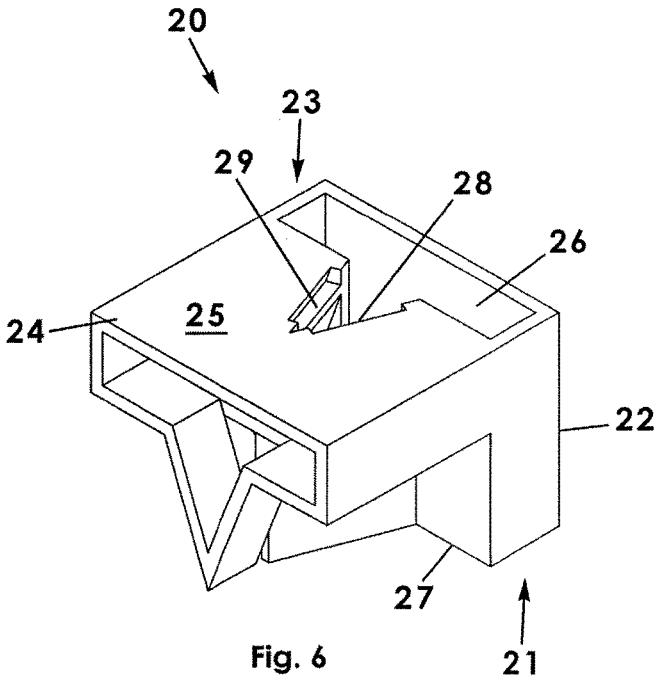
FIG. 6 is an isolated perspective view of a head member according to the present invention.
Figure 7A:
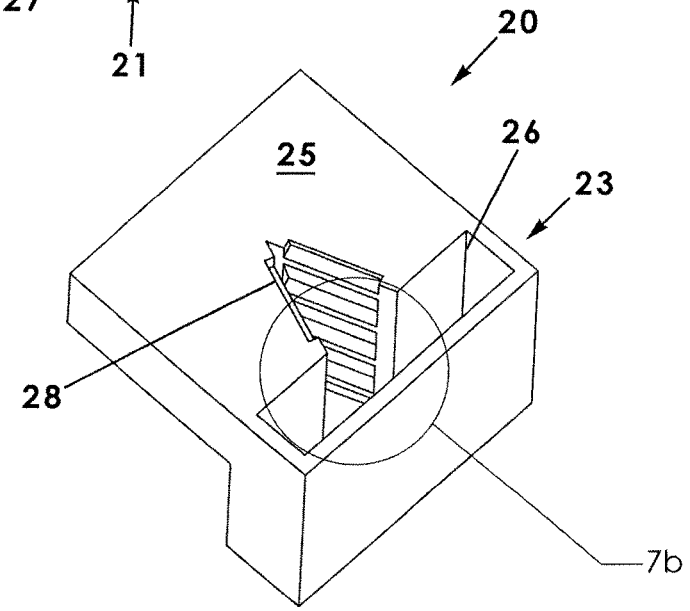
FIG. 7*a* is an isolated perspective view from another angle of the head member as in FIG. 6.
Figure 7B:
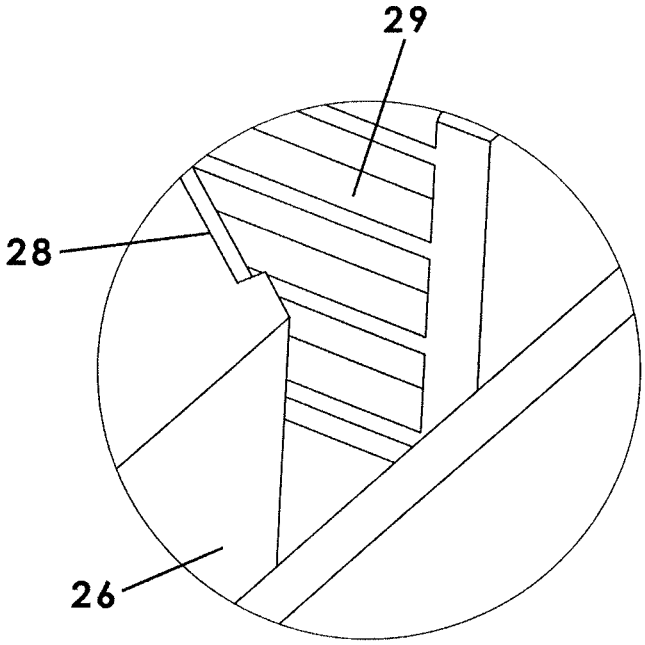
FIG. 7*b* is an isolated view on an enlarged scale taken from FIG. 7*a*1
Figure 8:
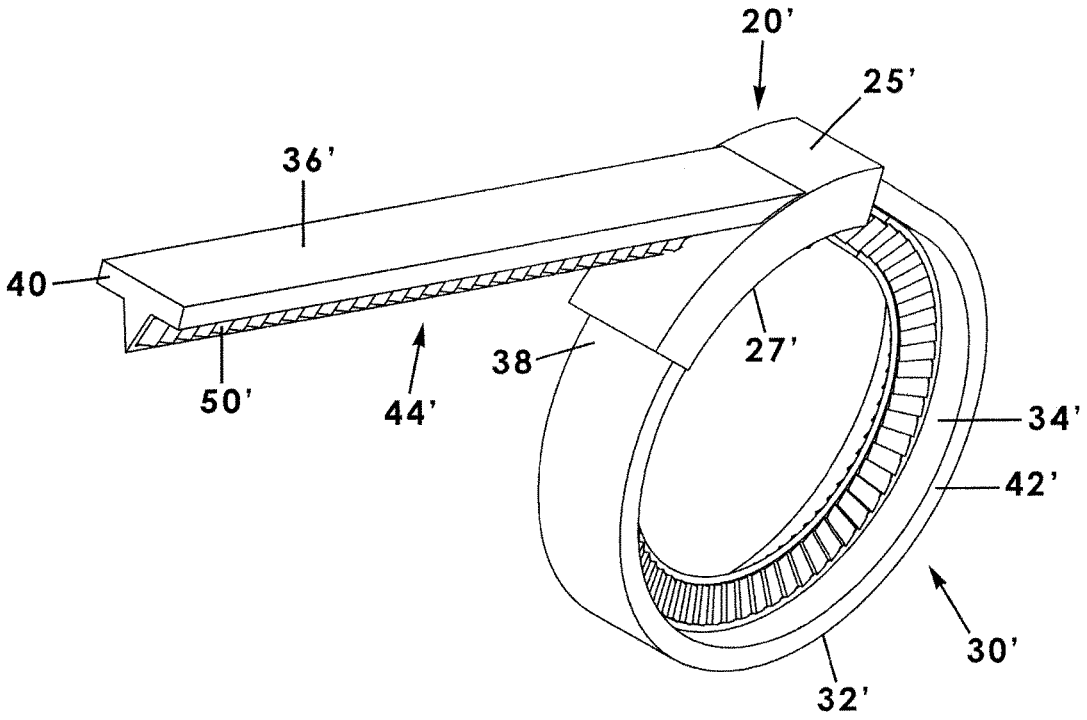
FIG. 8 is a perspective view of the cable tie device as in FIG. 2.
Figure 9A:
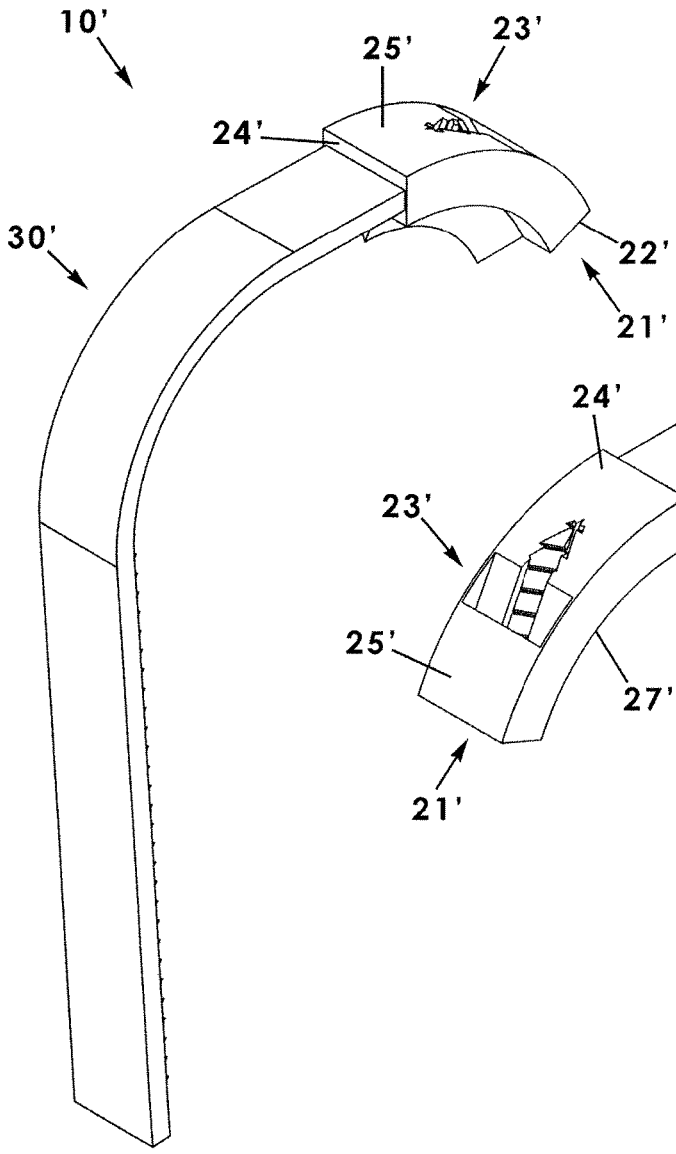
FIG. 9*a* is a rear perspective view of the cable tie device as in FIG. 8.
Figure 9B:
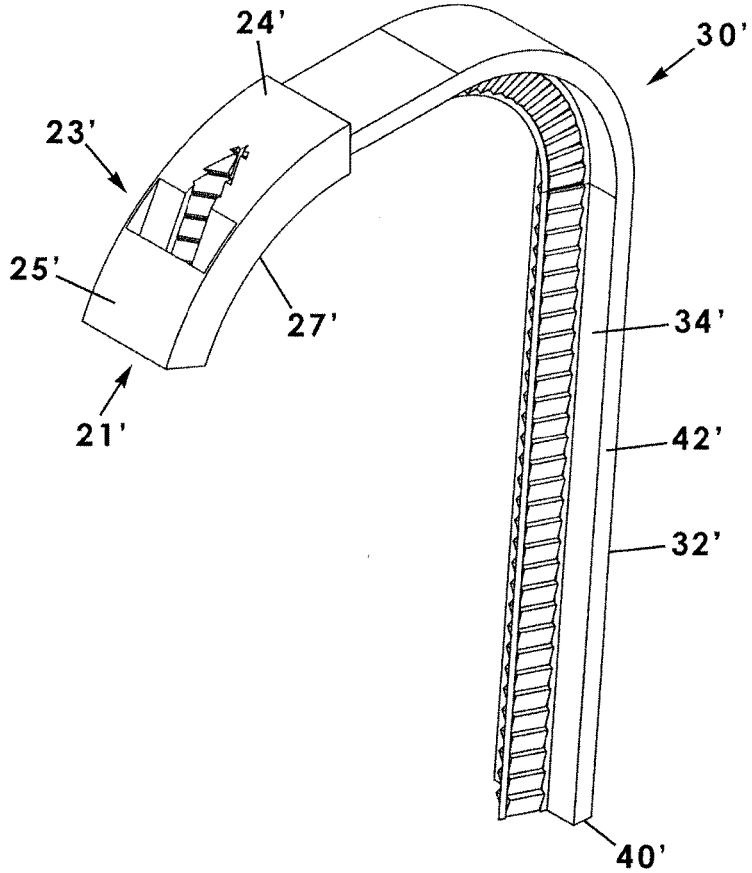
FIG. 9*b* is a front perspective view of the cable tie device as in FIG. 8.
Figure 10:
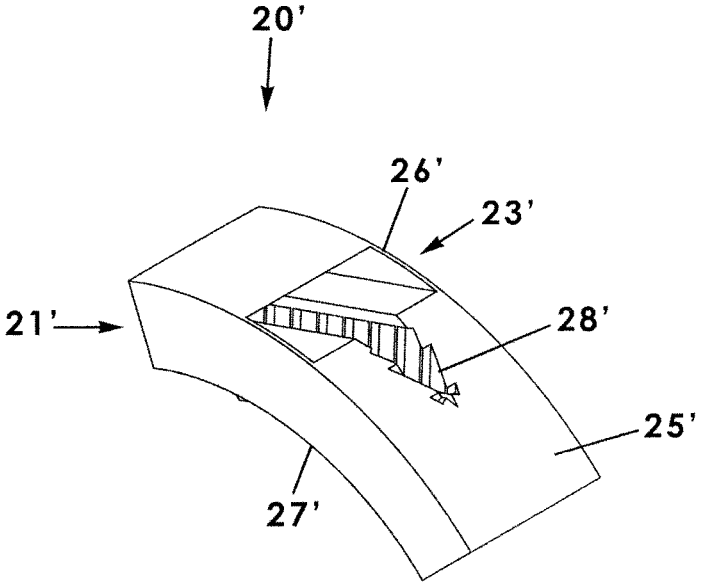
FIG. 10 is an isolated view of a head member as in FIG. 9*a;*
Figure 11A:
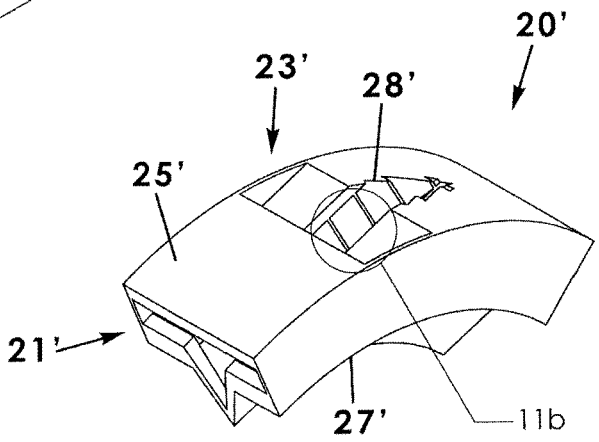
FIG. 11*a* is an isolated view from another angle of the head member as in FIG. 10.
Figure 11B:
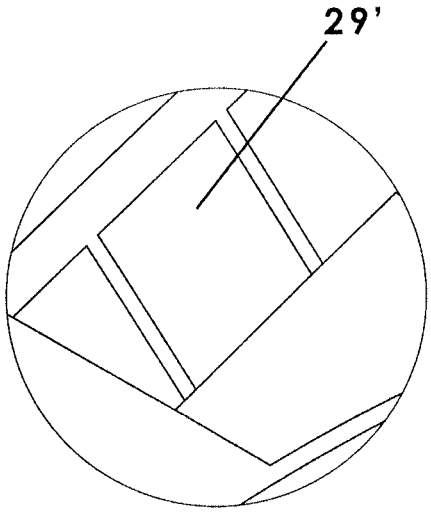
FIG. 11*b* is an isolated view on an enlarged scale taken from FIG. 11*a;*
Figure 12A:
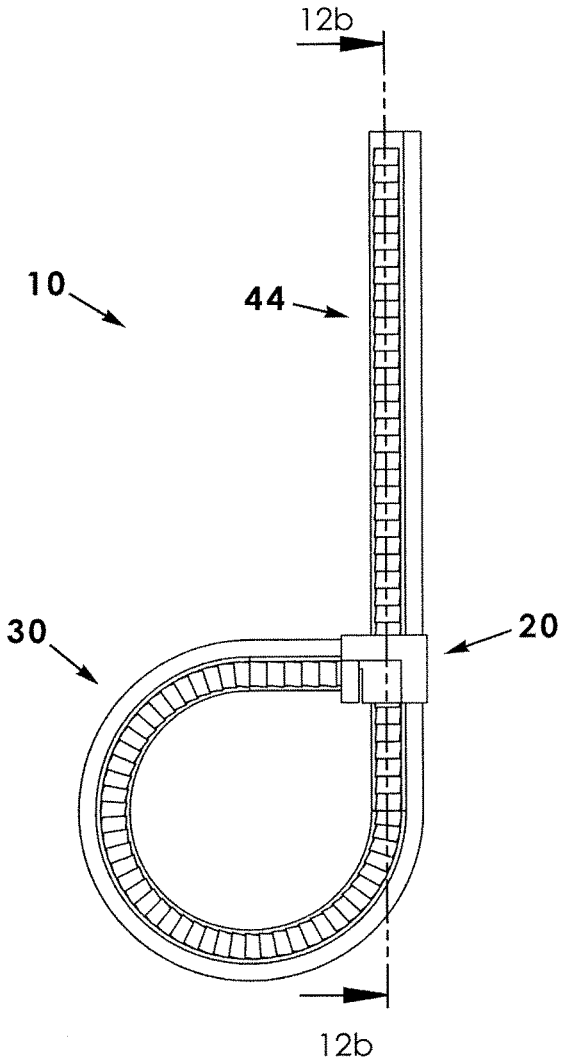
FIG. 12*a* is a side view of the cable tie device as in FIG. 3.
Figure 12B:
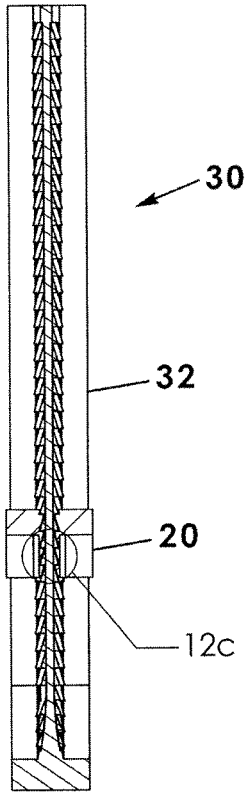
FIG. 12*b* is a sectional view taken along line 12*b*-12*b* of FIG. 12*a;*
Figure 12C:
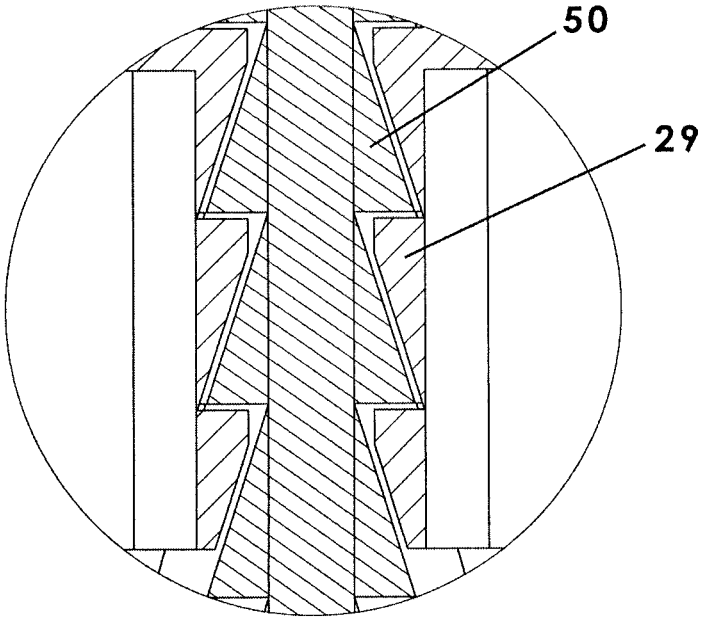
FIG. 12*c* is an isolated view on an enlarged scale take from FIG. 12*b;*
Figure 13B:
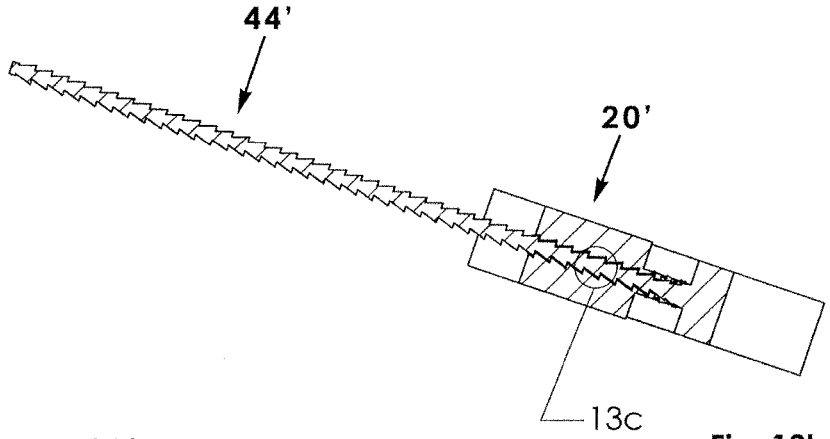
FIG. 13*b* is a sectional view taken along line 13*b*-13*b* of FIG. 13*a*.
Figure 13A:
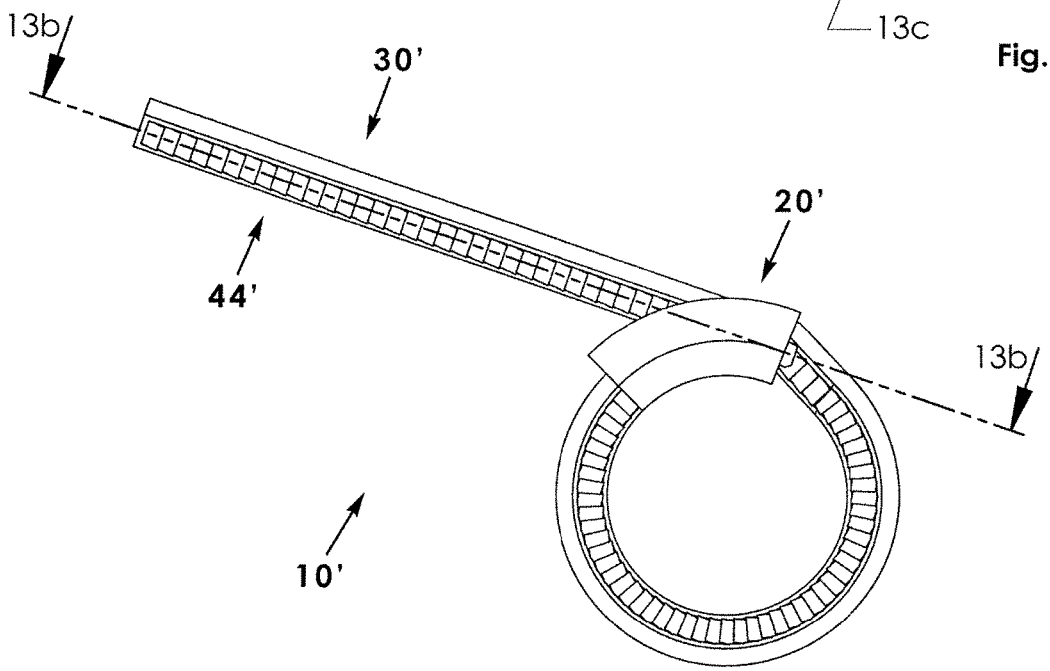
FIG. 13*a* is a side view of the cable tie device as in FIG. 8.
Figure 13C:
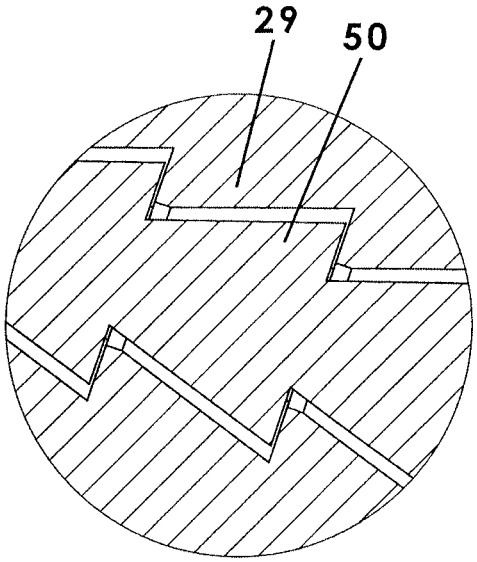
FIG. 13*c* is an isolated view on an enlarged scale take from FIG. 13*b*.

More particularly, the head member 20' itself may have a more flattened and curved shape configuration defining a hollow interior area. The gently curved configuration of the head member 20' makes it uniquely suited for a bottom wall 27' to rest upon a curved surface of an object being secured, such as a cylindrical hose, hexagonal fastener such as a bolt head or nut (FIG. 2). The head member 20' defines an inlet 21' at an outer end 22' and defines an outlet 23 in a top wall 25' through which the tying strap 30 may be fed through in substantially the same ratcheting relationship described earlier. It can be seen that the outlet 23 is displaced from the outer end 22' such that the tying strap 30 is pulled through at a flatter angle (compared to the angle defined by the aperture 26 and channel 28 of the embodiment first described above).

It is understood that while certain forms of this invention have been illustrated and described, it is not limited thereto except insofar as such limitations are included in the following claims and allowable functional equivalents thereof.

The invention claimed is:

1. A multi-surface cable tie device, comprising:

a head member having an outer end and an opposed inner end, said head member defining an aperture;

an elongate tying strap that includes a base strip having a generally planar configuration that includes a proximal end adjacent said inner end of said head member and a distal end opposite said proximal end, said base strip having an elongate toothed portion mounted to an inside surface of said base strip;

wherein said toothed portion includes a generally V-shaped configuration having a plurality of teeth extending away from said base strip;

wherein said aperture of said head member defines a generally rectangular configuration for selectively receiving said base strip and a channel defining a generally V-shaped configuration in communication with said aperture for selectively receiving said toothed portion of said tying strap.

2. The multi-surface cable tie device as in claim 1, wherein:

said toothed portion includes a first side wall that is inclined inwardly and a second side wall that is inclined inwardly;

each side wall includes a lower end adjacent and coupled to an inner surface of said base strip, said side walls being spaced apart from one another, respectively;

said first and second side walls extend away from said inside surface of said base strip so as to form an apex.

3. The multi-surface cable tie device as in claim 2, wherein:

said channel defined by said head member includes a first surface defining a plurality of ratchet teeth and extending inwardly and a second surface defining a plurality of ratchet teeth, said first and second surfaces extending inwardly to form a nested junction;

said channel and said plurality of ratchet teeth are configured to selectively mate in a ratchet engagement.

4. The multi-surface cable tie device as in claim 3, wherein said ratchet teeth are configured as a pawl such that said plurality of teeth of said toothed portion are receivable only in a forward direction relative to said plurality of ratchet teeth when said toothed portion of said tying strap is received by said head portion.

5. The multi-surface cable tie device as in claim 1, wherein said base strip includes a pair of side edges that extend between said proximal and distal ends and that are parallel to one another.

6. The multi-surface cable tie device as in claim 1, wherein said tying strap is received into said aperture and said channel distal end first.

7. The multi-surface cable tie device as in claim 4, wherein said tying strap is not removable from said head member when received therein.

8. The multi-surface cable tie device as in claim 1, wherein said base strip includes an outside surface having a smooth configuration.

9. The multi-surface cable tie device as in claim 5, wherein said toothed portion is positioned about midway between said side edges of said base strip and extends laterally on opposed sides of said toothed portion.

10. The multi-surface cable tie device as in claim 1, wherein said toothed portion of said tying strap includes a cross-section having a triangular configuration.

11. A multi-surface cable tie device, comprising:

a head member having an outer end and an opposed inner end, said head member defining an aperture having rectangular configuration and a channel defining a generally V-shaped configuration in communication with said aperture;

an elongate tying strap that includes a base strip having a planar configuration that includes a proximal end adjacent said inner end of said head member and a distal end opposite said proximal end, said base strip having an elongate toothed portion mounted to an inside surface of said base strip;

wherein said toothed portion includes a generally triangular cross-section and having a plurality of teeth extending away from said base strip;

wherein said aperture is configured to selectively receive said base strip and said channel is configured to receive said toothed portion of said tying strap.

12. The multi-surface cable tie device as in claim 11, wherein:

said toothed portion includes a first side wall that is inclined inwardly and a second side wall that is inclined inwardly;

each side wall includes a lower end adjacent and coupled to an inner surface of said base strip, said side walls being spaced apart from one another, respectively;

said first and second side walls extend away from said inside surface of said base strip so as to form an apex.

13. The multi-surface cable tie device as in claim 12, wherein:

said channel defined by said head member includes a first surface defining a plurality of ratchet teeth and extending inwardly and a second surface defining a plurality of ratchet teeth, said first and second surfaces extending inwardly to form a nested junction;

said channel and said plurality of ratchet teeth are configured to selectively mate in a ratchet engagement.

14. The multi-surface cable tie device as in claim 13, wherein said ratchet teeth are configured as a pawl such that said plurality of teeth of said toothed portion are receivable only in a forward direction relative to said plurality of ratchet teeth when said toothed portion of said tying strap is received by said head portion.

15. The multi-surface cable tie device as in claim 11, wherein said base strip includes a pair of side edges that extend between said proximal and distal ends and that are parallel to one another.

16. The multi-surface cable tie device as in claim 11, wherein said tying strap is received into said aperture and said channel distal end first.

17. The multi-surface cable tie device as in claim 14, wherein said tying strap is not removable from said head member when received therein.

18. The multi-surface cable tie device as in claim 11, wherein said head member includes a curved configuration capable of resting atop a curved object.

19. The multi-surface cable tie device as in claim 15, wherein said toothed portion is positioned about midway between said side edges of said base strip and extends laterally on opposed sides of said toothed portion.

20. The multi-surface cable tie device as in claim 11, wherein said distal end of said tying strap includes a rectangular configuration that is complementary to the rectangular configuration of said aperture of said head member so as to be selectively received therein.

* * * * *